United States Patent [19]

Reichert

[11] 4,065,812

[45] Jan. 3, 1978

[54] SWITCH FOR CONTROLLING DOOR LOCKS

[76] Inventor: Dieter Reichert, Bismarckstrasse 49, 7031 Gartringen - BRD, Germany

[21] Appl. No.: 723,082

[22] Filed: Sept. 14, 1976

[30] Foreign Application Priority Data

Aug. 5, 1976 Germany ..... 2635255

[51] Int. Cl.[2] ..... H01H 19/36; H01H 27/00

[52] U.S. Cl. ..... 200/11 R; 200/11 A; 200/44; 200/252; 200/275

[58] Field of Search ..... 200/11 R, 11 A, 11 C, 200/11 H, 11 J, 42 R, 44, 45, 275, 276, 277, 252

[56] References Cited

U.S. PATENT DOCUMENTS

| | | | |
|---|---|---|---|
| 2,467,758 | 4/1949 | Lindenblad | 200/11 R X |
| 2,980,770 | 4/1961 | Nabstedt | 200/11 A |
| 3,053,956 | 9/1962 | Clavel | 200/11 A X |
| 3,259,727 | 7/1966 | Casler | 200/276 |

FOREIGN PATENT DOCUMENTS

| | | | |
|---|---|---|---|
| 711,803 | 6/1956 | Canada | 200/11 R |

*Primary Examiner*—James R. Scott

[57] ABSTRACT

The switch comprises a stator which is rigidly secured to a lock cylinder case and a rotor which is rigidly fixed to a lock cylinder. The rotor rotates within the stator which has two concentric and partially overlapping circular arc conductors. The rotor drives an elliptical slip ring in a groove between the conductors and between one of the conductors and a slide surface where the conductors do not overlap. The frictional connection between the conductors and the slip ring holds the slip ring from being fully drawn out of contact with both conductors when the locking cyclinder is turned from closed to neutral position and holds the slip ring from being drawn into contact with both conductors when the locking cylinder is turned from open to neutral position.

17 Claims, 4 Drawing Figures

SWITCH FOR CONTROLLING DOOR LOCKS

BACKGROUND OF THE INVENTION

The invention relates to a switch for controlling door locks, which door locks comprise a non-rotatable locking cylinder case and a lock cylinder which can be rotated from outside by an inserted door key, as well as a resetting spring for returning the locking cylinder to the neutral position from the "open" position and to the neutral position from the "closed" position. Such door locks are typical of automobiles, trailers, trucks, and sometimes of motor cycles, front doors of houses, etc.

Door locks e.g. on automobiles comprise a locking cylinder case which is rigidly connected to the door. A locking cylinder is rotatably mounted in the case. A key can be inserted into its slit from the outside. Springs are always active between the case and the locking cylinder. If neither of the springs is tensioned, the locking cylinder occupies its central position. In this position a key can be introduced into the slit of the keyhole. In cases where door locks lock on the righthand side, the key must then be moved in a clockwise direction thereby moving a driver mechanism inside the door which controls the mechanism in the door interior so that the door is closed. The key is then released or actively returned to its neutral position, the driver also being moved into the neutral position. The spring mechanism ensures that the neutral position is reached and also maintained during travel. If it is desired to open the door, the key in a door lock which locks on the right side is turned in an anticlockwise direction after its insertion thus causing the driver, rigidly attached to the locking cylinder, to move anticlockwise and therefore controlling the locking mechanism inside the door so that the door is opened. Then the key is released again or caused to return to the neutral position. This is ensured by a spring mechanism which maintains this position also during travel.

In addition to the door locks which lock on the right side, there are also locks which lock on the left side. One feature common to all locks, however, is the automatic or forced return to the neutral position due to active rotation or the return springs.

The angle through which the key must be turned to open or close the door can vary greatly. With some automobile models it is in the region of $\pm$ 10° while on other models the key must be rotated even by more than $\pm$ 100°.

There has been a growing trend towards the use of security systems in large numbers intended to prevent the unauthorized use, or even loading of automobiles since break-ins and thefts from automobiles have increased considerably. These systems have one or several of the following disadvantages:

a. They are costly.

b. They must be actuated separately when leaving the car, e.g. by pressing a switch, which can be forgotten.

c. A theft can observe whether security precautions are taken when leaving the car.

d. In practice the systems are only suitable for certain types of cars.

e. The rightful owner cannot cancel the actuated alarm sufficiently quickly himself so that he may be mistaken for a thief by passers-by. An alarm can be activated by mistake e.g. if a further article which has been forgotten is taken from the trunk after the doors are closed and the security system actuated.

f. It is often easy to render the actuating switch inoperative.

g. A special key is required in place of the original key.

SUMMARY OF THE INVENTION

The object of the invention is to provide an actuating switch which is cheap, does not require special handles or grips for actuation, is capable of meeting all space requirements, and can be used on door locks which close on both the left and right sides, irrespective of whether the locks are provided with a locking cylinder having a substantially flat inner face or comprise an inner face cut in the shape of a circular segment. The switch should therefore be usable in conjunction with all known locking cylinders. Moreover, assembly of the switch should be simple and it should not have any of the above-mentioned disadvantages.

This problem is solved in accordance with the invention by the following features:

a. The switch comprises a stator which is rigidly and non-rotatably connected to the locking cylinder case and is coaxial with the geometric longitudinal axis of the door lock.

b. The switch comprises a rotor which is rigidly and non-rotatably connected to the locking cylinder of the door lock, is coaxial to the geometric longitudinal axis of the door lock and rotatably mounted by the stator.

c. In the stator are provided two electric conductors of circular arc form which extend coaxially and concentrically with one another and overlap in a first angular section, but not in the second angular section, a non-conductive slide being provided in the second angular section.

d. Between the conductors there is provided an electrically conductive slip ring which is in contact with both conductors and comprises an eye or hole in which a driver of the rotor engages.

e. The frictional connection between the slip ring and the conductors or slide is such that the slip ring can only be moved out of its once occupied position by the driver.

f. The slip ring and the eye for engaging the driver have an angular length such that the slip ring is drawn between the conductors when the locking cylinder is turned into the "closed" position, but not fully drawn out of this position for contacting the conductors when the locking cylinder is returned to the neutral position, and the slip ring is drawn into the area of the slide when the locking cylinder is rotated into the "open" position, but not fully drawn out of this position, which does not contact at least one of the conductors, when the locking cylinder is returned to the neutral position.

It is therefore possible to both close the door with the same original key and render the switch operative or inoperative without any additional unaccustomed movements.

The stator is arranged externally and the rotor internally of each other. This feature makes it possible for the stator to be simply connected rigidly to the locking cylinder case and for the rotor to be simply connected to the locking cylinder.

The stator is flattened on the the lying opposite the slip ring. Through these features it is possible for the switch to be also used with those door locks, the inner faces of which are not substantially flat, but comprise a recess in the form of a circular segment.

The stator has a circular arc shaped groove and a first of the conductors is supported on one wall of the circular arc-shaped groove while the second conductor is supported on the other wall of the groove, and in which the slide surface comprises the other wall in an extension of the second conductor. These features enable both wall of the groove to be used for the conductors and a 360° long groove is therefore not required. Indeed, the groove can be kept as short as required by the door lock with the widest turning angle.

And the conductors are made in one piece and extend through the openings. As a result of these features the position of the points of connection is always the same, irrespective of whether the switch is used in a door lock locking on the left or right side. Moreover, openings can be used at the same time as fastening points for the conductors.

The conductor lying on the inner wall of the groove in considerably longer than 180° in angular length. As a result of these features the inner conductor-in addition to the opening or fastening point-can adhere to the inner wall of the groove. Adhesive or additional retaining cams are not then required and assembly is simple.

The inner conductor is 240° to 260° in angular length. As a result of these features the switch can also be used on those door locks which have the maximum angle of turn according to the knowledge of the inventor.

The outer conductor has an effective angular length of between 100° and 130°. As a result of these features the outer conductor path can also correspond to both the minimum and maximum angles of rotation of the door locks.

The inner conductor is positively retained on the inner wall and the opening. As a result of these features no additional element is required to retain the inner conductor since the inner wall is in any case necessary, as is the opening. If the opening is designed as an open-edged slot, the conductor only needs to be mounted during assembly. Any occuring torque can also be absorbed in the opening.

And openings are provided on oppositely lying sides of the stator and one end of the second conductor comprises an outwardly directed bent section which fits in the retaining groove and is positively retained therein, one of the openings forms the other positive connection and the groove wall in the area of the second conductor is staggered outward by the thickness of one conductor. As a result of these features the slip ring can always have the same shaped path and also the outer conductor can be fitted simply by insertion.

The openings are parallel to the same secant. These features enable assembly to be simplified and material below the secant to be omitted so that the flat side mentioned above can be formed.

The slip ring is an approximately oval ring which is almost as wide as the conductors and in which the driver engages. As a result of these features it is possible to have a simple slip ring which is well sprung and adapts well and at the same time permits the necessary return stroke.

The sides of the slip ring form circular arcs which are adapted to follow the shape of the conductors and slide surface. As a result of these features the ring may be supported over a wide area so as to reduce wear and minimize electric transition resistance.

The slip ring has an angular length of between 35° and 60°. A slip ring thus can also be used in door locks having a very small angle of turn, but on the other hand it is not imperative for the stator to be practically circular and without a substantially flattened edge.

BRIEF DESCRIPTION OF THE DRAWING FIGURES

Other advantages and features of the invention are evident from the following description of a preferred embodiment. The following are shown as detail drawings on a basic scale of 10:1:

DETAILED DESCRIPTION OF THE ILLUSTRATED EMBODIMENT

Figure 1:
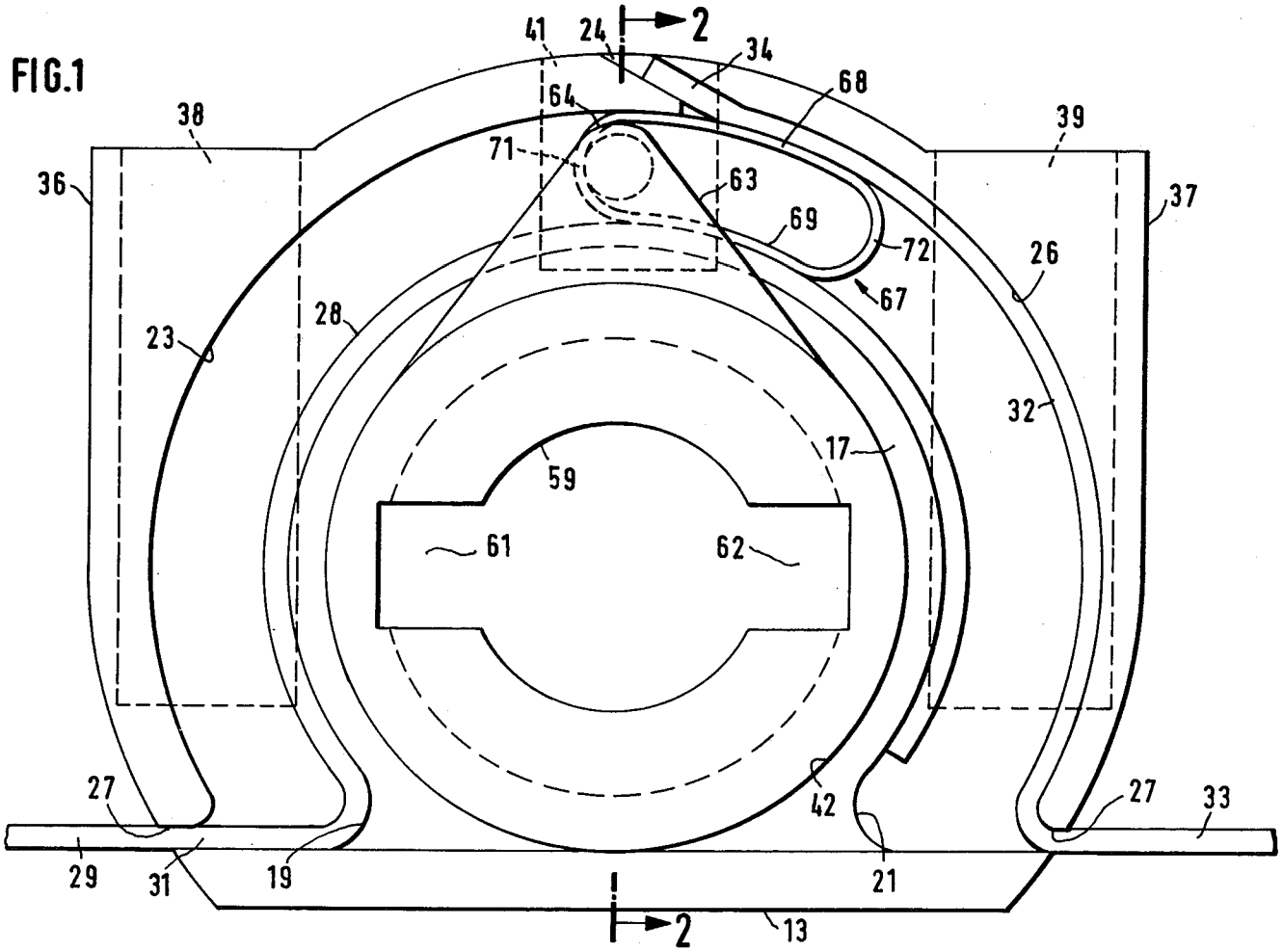
FIG. 1 is a front view of the switch without cover and snap ring.
Figure 3:
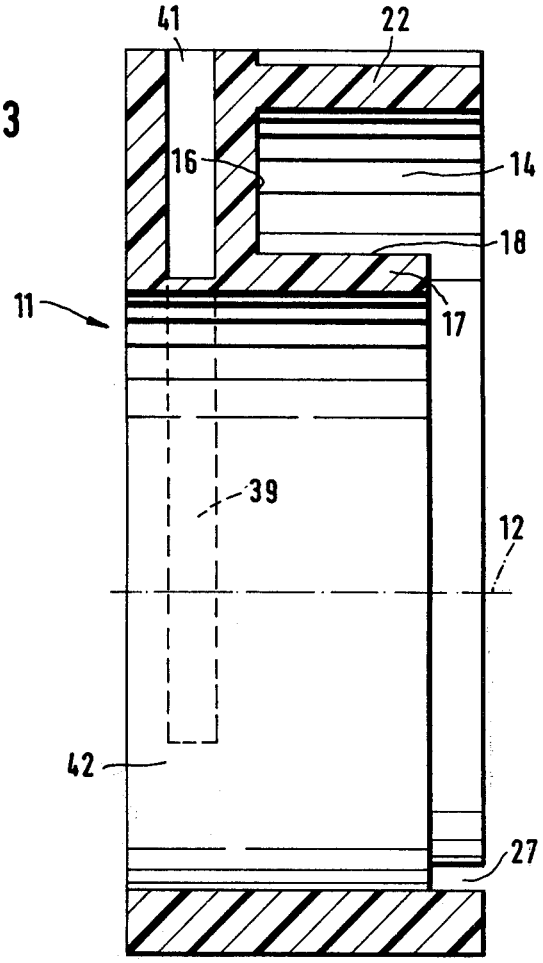
FIG. 3 is a section similar to FIG. 2, but only through the stator without the conductors.

A stator 11 is made in one piece of injection-molded plastic material. Its geometric longitudinal axis 12 is parallel to the geometric longitudinal axis of a door lock (not shown) which can be located either to the right or left of the stator and the locking cylinder case of which is non-rotatably connected to the stator 11 in an unshown manner. As shown in FIG. 1, the bottom of the stator 11 comprises a flat edge 13 which is perpendicular to the plane of section 2—2. Coaxial with the longitudinal axis 12 and symmetrical with this section plane, a groove 14 of approximately omega shape is provided in the stator 11. As shown in the drawing the groove extends over an angle of 265°. Its bottom 16 is flat and parallel to the plane of the drawing shown in FIG. 1. An inner side wall 17 of the groove 14 lies concentrically with the longitudinal axis 12 and its outer face 18, with the exception of the curved or arched ends 19, 21, lies coaxially with the longitudinal axis 12, on a circular cylindrical wall. As shown in FIG. 3 the side wall 17 of the groove is 2.9 mm long. The outer side wall 22 is 3.8 mm and therefore, as seen in FIG. 3, extends further to the right than the side wall 17. The inner face 23 of the groove side wall according to FIG. 1 runs concentrically with the geometric longitudinal axis 12 by approximately 8° after the plane of the section 2—2. This is followed by a slot 24 which runs from bottom right to top left in the direction of a secant and comprises a bottom and side walls, the latter being perpendicular to the plane of the drawing in FIG. 1. The slot 24 is open when viewed in the direction of FIG. 1. The slot 24 is followed by an inner face 26 which is also perpendicular to the plane of the drawing in FIG. 1 and concentric with the longitudinal axis 12. The cylindrical wall on which it lies is however 0.4 mm greater than the radius associated with the inner face 23. At the left hand end of the groove 14 shown in FIG. 1 there is provided an opening 27 and at the right hand end an opening 27 which takes the shape of a slot which can be refilled, similar to the slot 24.

An inner conductor 28 is made of a length of metal of rectangular cross section, and comprises a connecting lug 29, which extends through the opening 27 with a straight section 31, then bends to form the curved end 19 and encloses the outer face 18 over an angle of 250°. It does not therefore extend fully into the curved end 21 for safety reasons.

The outside of a second conductor 32 comprises a straight connecting lug 33 which extends through the opening 27 with a sharply bent section and then follows the cylindrical shape of the inner face 26 in an anticlockwise direction, through an angle of 118°. The two conductors 28,32 therefore extend from opposite sides through this angle of 118°. The inner end of the conductor 32 comprises an outwardly directed angled section 34 which fits into the slot 24 so that the conductor 32 is also positively retained therein.

Figure 2:
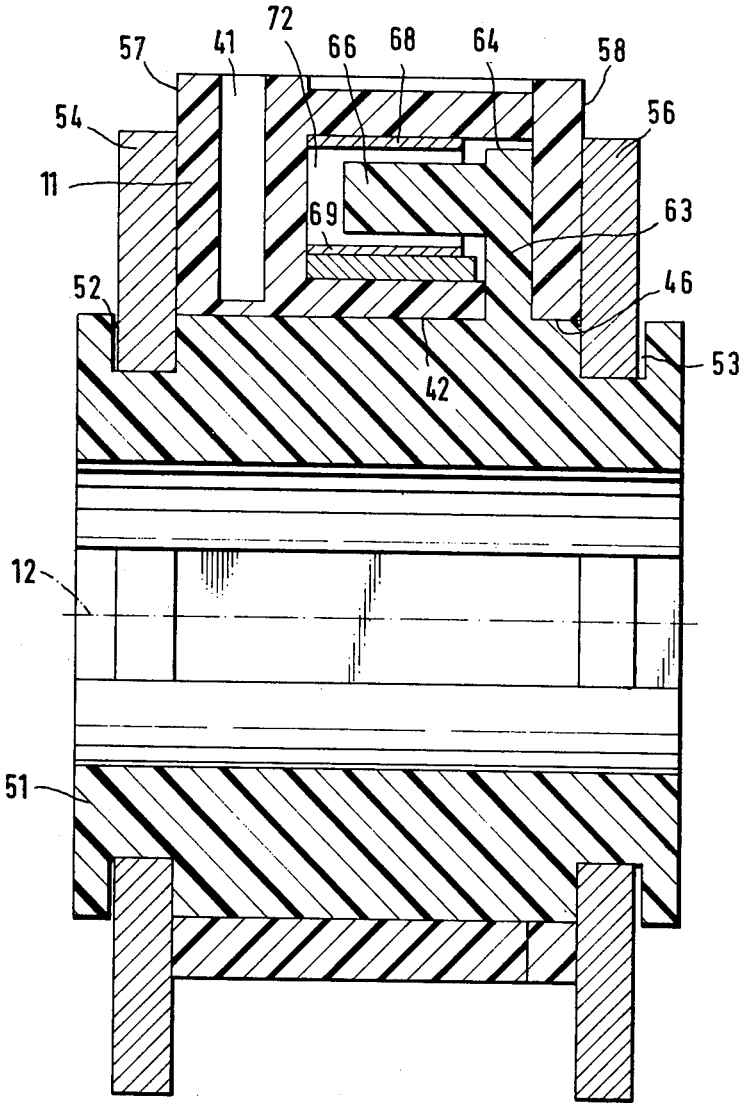
FIG. 2 is a section along the line 2—2 shown in FIG. 1, but with the cover and snap ring.

The stator 11 comprises on both sides wings 36,37 in which are provided rectangular pockets 38,39 accessible from above as shown in FIG. 1. Between these wings 36,37 is a third rectangular pocket 41, also accessible from above, and located behind the bottom of the groove as shown in FIG. 2 (as are also the pockets 38,39). The pocket 41 is substantially shorter than the pockets 38,39 and all the pockets are parallel to one another. Therefore, to fix the stator 11 on the locking cylinder case the prongs of a fork-like fastener, which is in turn attached to the locking cylinder case, can be introduced into these pockets 38 to 41.

Figure 4:
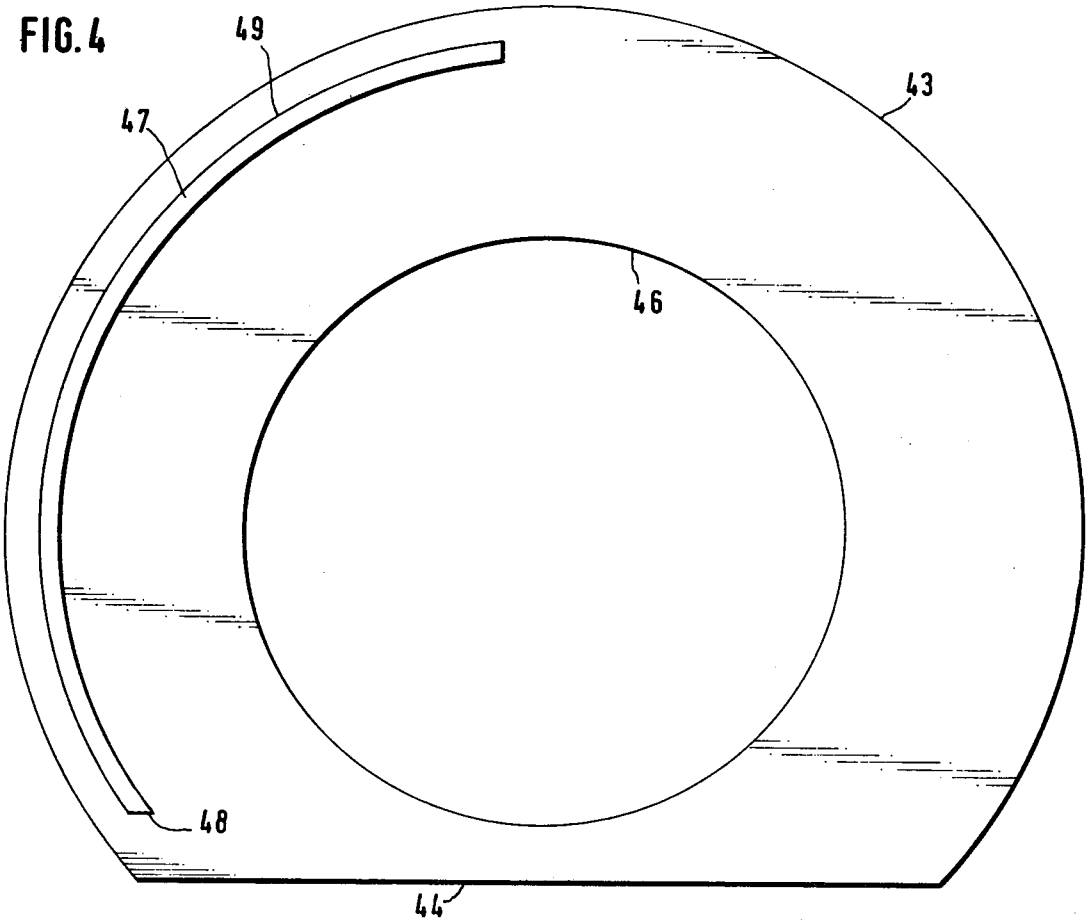
FIG. 4 is an inner front view of the cover.

The stator 11 comprises a bore 42 of 10 mm diameter coaxial with the longitudinal axis 12. As shown in FIG. 1, the stator 11 can be closed at the front by a cover 43 having a diameter of 18 mm, which cover comprises a flat edge 44 at the bottom parallel to the flat edge 13, a bore 46 parallel to the bore 42, and, as shown in FIG. 4, a positioning rib 47 of rectangular cross section which extends through 122°, its lower end 48 lying above the section 31 and its outer face 49 bearing against the inner face 23. However, the positioning rib is only as high as the difference between the lengths of the side walls 17 and 22 of the groove.

The axial length of the stator 11 is 6 mm. A rotor 51 having a substantially cylindrical body extends through the bore 42 of the stator and through the bore 46.

In its circumferential sections projecting beyond the stator 11 or the cover 43 there are provided circumferential grooves 52,53 in which snap rings 54,56 can be inserted, the inner faces of the later guiding the rotor 51 axially rigidly along the radial faces 57 of the stator or 58 of the cover 43. In the body of the rotor 51 there is provided a coaxial bore 59 of smaller diameter which has a through hole and extends into two diametrically opposite longitudinal grooves 61, 62. As shown in FIG. 1, this line is parallel to the flat edge 13 or perpendicular to the plane of the section 202 when the rotor 51 is in the netural position. At its top right hand section shown in FIG. 2 the rotor 51 passes into a triangle 63 which is only of such thickness that it fits between the face of the groove side wall 17 and the cover 43 and, even in the final assembled state, lies at the point shown in FIG. 2. Moreover, the triangle 63 comprises an apex 64 which is spaced therefrom so as to preclude contact with the positioning rib 47 and naturally also the groove side wall 22.

The triangle 63 comprises a cylindrical pin 66 directed to the left as shown in FIG. 2, the diameter of said pin being substantially less than the clear width between the conductors 28,32. It projects deeply into the groove 14, and is located inside a slip ring 67 made of metal and 45° long. It is made of a circular band. Its outer flank 68 is adapted to the radius of the inner face 23 or the inner face of the conductor 32. Its inner flank 69 is adapted to the outer face of the conductor 28. The sides 68,69 extend into semicircular arcs 71,72 on either side.

The longitudinal grooves 61,62 can receive drivers which are provided in series in some known door locks or if necessary are provided separately.

The supervisory control circuit which can consist e.g. of a battery, sensor and alarm signal generator can be located between the connecting lugs 29,33.

The mode of operation of the switch according to the invention is as follows:

It is assumed that the door lock is one which locks on the right side. The locking cylinder occupies its neutral position. In this position the pin 66 is located as shown in FIG. 1. The key is not turned clockwise. Depending on the type of lock the angle of turn varies from a minimum of 15° to a maximum of 200°. In this connection the slip ring 67 is moved by the pin 66 and produces a contact between conductor 28 and conductor 32, irrespective of its starting position and after a certain rotation of the rotor 51. After the rotation for locking is completed, the key is guided back again into the neutral position. If the pin 66 previously engaged in the semicircular arc 72, it now engages in the semicurcular arc 71 after a return stroke determined by the length of the slip ring 67 and moves the slip ring 67 again in a anticlockwise direction until it occupies the position shown in FIG. 1. During the entire return movement and also in the neutral position the slip ring 67 makes a contact between the conductors 28 and 32; in the neutral position because firstly the slip ring 67 is sufficiently long to bridge the non-overlapping angular section between the conductors 28 and 32 and secondly, it is not so short that the pin 66 cannot make any return stroke at all. Although the locking cylinder has returned to its neutral position, the switch remains closed and the alarm system activated.

If it is desired to open the door lock, the key is inserted again, the locking cylinder occupying its neutral position as before. The turning angle in the anticlockwise direction is again at least 15° and at the most 220°, depending on the type of vehicle. After a certain angle of turn the contact between the conductors 28,32 is broken. If the user now releases the key or returns it to the neutral position, the contact remains broken because the pin 66 now engages in the semicircular arc 72 and the slip ring 67 is now located on the left side. The slip ring 67 is retained by friction in all of the given positions.

In the case of a lock which locks on the left, the switch according to the invention is simply fitted so that the door lock is now located to the right of the switch as shown in FIG. 2.

If the alarm has been initiated by mistake because e.g. the trunk has been opened after the system is activated, it is only necessary to reopen the door lock and the alarm is switched off. No alarm occurs at all in those cases where the system reacts to a break-in after a certain time lag. This is frequently done so that a thief does nor immediately know whether his action has been successful or not or whether the car is locked or not.

What I claim is:

1. A switch for controlling door locks, which door locks comprise a non-rotatable locking cylinder case, a locking cylinder which can be rotated from outside by an inserted door key, a resetting spring for returning the locking cylinder to a neutral position from an "open" position and to the neutral position from a "closed" position, which switch comprises:

a stator which is rigidly and non-rotatably connected to the locking cylinder case and is coaxial with the geometric longitudinal axis of the door lock, a rotor which is rigidly and non-rotatably connected to the locking cylinder of the door lock, is coaxial to the geometric longitudinal axis of the door lock and rotatably mounted by the stator and has a driver thereon, said stator being provided with two electric conductors of circular arc form which extend coaxially and concentrically with one another and overlap in a first angular section, but not in the second angular section, a non-conductive slide surface in the second angular section, and an electrically conductive slip ring between the conductors which contacts both the conductors and comprises an aperture in which said driver of said rotor engages, the frictional connection between said slip ring and said conductors and said slide surface being such that said slip ring can only be moved out of a position of rest by said driver, said slip ring and said aperture for engaging said driver having an angular length such that said slip ring is drawn between said conductors when the locking cylinder is turned into the "closed" position, but not fully drawn out of this position of contacting the conductors when the locking cylinder is returned to the neutral position, and such that the slip ring is drawn into the area of said slide surface when said locking cylinder is rotated into the "open" position, but not fully drawn out of this position, which does not make contact with at least one of said conductors, when the locking cylinder is returned to the neutral position.

2. A switch as claimed in claim 1, in which said stator is arranged externally and said rotor internally of each other.

3. A switch as claimed in claim 2, in which said stator is flattened on the side lying opposite said slip ring.

4. A switch as claimed in claim 1, in which said stator has a circular arc shaped groove and a first of said conductors is supported on one wall of said circular arc-shaped groove while the second conductor is supported on the other wall of said groove, and in which said slide surface comprises said other wall in an extension of the second conductor.

5. A switch as claimed in claim 1 in which openings are provided on oppositely lying sides of said stator, and said conductors are made in one piece and extend through said openings.

6. A switch as claimed in claim 4, in which the conductor lying on the inner wall of said groove is considerably longer than 180° in angular length.

7. A switch as claimed in claim 6, in which said inner conductor is 240° to 260° in angular length.

8. A switch as claimed in claim 6, in which said inner conductor is 250° in angular length.

9. A switch as claimed in claim 6, in which the outer conductor has an effective angular length of between 100 and 130°.

10. A switch as claimed in claim 6 in which the outer conductor has an effective angular length of 120°.

11. A switch as claimed in claim 6, in which openings are provided on oppositely lying sides of said stator and the inner conductor is positively retained on said inner wall and said opening.

12. A switch as claimed in claim 4, in which said stator is provided with a retaining groove running in the direction of a secant, and openings are provided on oppositely lying sides of said stator and one end of the second conductor comprises an outwardly directed bent section which fits in said retaining groove, one of said openings forms the other positive connection and the groove wall in the area of the second conductor is staggered outward by the thickness of one conductor.

13. A switch as claimed in claim 5, in which said openings are parallel to the same secant.

14. A switch as claimed in claim 1, in which said slip ring is an approximately oval ring which is almost as wide as said conductors and in which said driver engages.

15. A switch as claimed in claim 12, in which said sides of said slip ring form circular arcs which are adapted to follow the shape of said conductors and surface.

16. A switch as claimed in claim 1, in which said slip ring has an angular length of between 35° and 60°.

17. A switch as claimed in claim 1, in which said slip ring has an angular length of 45°.

* * * * *